US009343244B2

(12) United States Patent
Ishikawa et al.

(10) Patent No.: US 9,343,244 B2
(45) Date of Patent: May 17, 2016

(54) ENERGY-STORING UNIT WITH FORCING MECHANISM, AND ON-LOAD TAP CHANGING DEVICE

(75) Inventors: Taku Ishikawa, Kawasaki (JP); Naoki Eguchi, Yokohama (JP); Osamu Kakoki, Yokohama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 304 days.

(21) Appl. No.: 14/008,206

(22) PCT Filed: Mar. 28, 2012

(86) PCT No.: PCT/JP2012/058151

§ 371 (c)(1),
(2), (4) Date: Dec. 11, 2013

(87) PCT Pub. No.: WO2012/133535

PCT Pub. Date: Oct. 4, 2012

(65) Prior Publication Data

US 2014/0209440 A1 Jul. 31, 2014

(30) Foreign Application Priority Data

Mar. 28, 2011 (JP) ..... 2011-070782

(51) Int. Cl.
*H01H 19/00* (2006.01)
*H01H 21/00* (2006.01)
(Continued)

(52) U.S. Cl.
CPC ..... *H01H 9/0027* (2013.01); *H01F 29/04* (2013.01); *H01H 3/3052* (2013.01); *H01H 3/3015* (2013.01)

(58) Field of Classification Search
CPC ..... H01H 19/00; H01H 21/00; H01H 15/00; H01H 3/00; H01H 3/02; H01H 3/20; H01H 3/001; H01H 3/3031; H01H 3/3042; H01H 3/32; H01H 3/38; H01H 3/54; H01H 9/0044; H01H 69/00; H01H 71/00; H01H 71/02; H01H 71/0214; H01H 71/025; H01H 71/0264; H01H 71/0271; H01H 71/10; H01H 71/1072; H01H 71/128; H01H 71/50; H01H 71/52; H01H 71/521; H01H 71/522; H01H 71/523; H01H 71/524; H01H 73/06; H01H 73/24; H01H 73/38; H01H 73/50; H01H 73/60; H01H 2003/02
USPC ..... 200/11 TC, 18; 74/436, 97.1
See application file for complete search history.

(56) References Cited

U.S. PATENT DOCUMENTS 3,047,694 A * 7/1962 Sullivan ..... H01H 71/443 335/26
3,811,022 A 5/1974 Guidosh
(Continued)

FOREIGN PATENT DOCUMENTS

CN 2891237 Y 4/2007
CN 101894694 A 11/2010
(Continued)

OTHER PUBLICATIONS

The Extended European Search Report issued Nov. 4, 2014, in Application No. 12763295.8-1808 / 2693453.
(Continued)

*Primary Examiner* — Renee Luebke
*Assistant Examiner* — Anthony R. Jimenez
(74) *Attorney, Agent, or Firm* — Oblon, McClelland, Maier & Neustadt, L.L.P.

(57) ABSTRACT

An energy-storing unit with a forcing mechanism and an on-load tap changing device provided with the same which employ an inexpensive and simple structure and which can suppress a loading torque to operate stably. A forcing mechanism built in an energy-storing unit includes a protrusion, a bearing, and a loading cam. Among those components, the protrusion is attached to the bottom face of an eccentric cam, and the bearing is attached to the tip of the protrusion. The loading cam is an isosceles triangle having a vertex that is substantially 90 degrees, and is attached to the top face of an energy-storing case. The loading cam becoming in contact with the bearing causes a crank to rotate through the energy-storing case, and feeds a catch to a standby position.

4 Claims, 7 Drawing Sheets

(51) Int. Cl.

| | |
|---|---|
| ***H01H 9/00*** | (2006.01) |
| ***H01F 29/04*** | (2006.01) |
| ***H01H 3/30*** | (2006.01) |

(56) References Cited

U.S. PATENT DOCUMENTS

| | | | | |
|---|---|---|---|---|
| 8,748,758 | B2 | 6/2014 | Hoepfl et al. | |
| 2008/0093207 | A1 | 4/2008 | Wrede et al. | |
| 2009/0151486 | A1* | 6/2009 | Jonsson | H01H 9/0027 74/63 |
| 2012/0103766 | A1 | 5/2012 | Hoepfl et al. | |

FOREIGN PATENT DOCUMENTS

| | | | |
|---|---|---|---|
| CN | 102473539 | A | 5/2012 |
| DE | 198 55 860 | C1 | 2/2000 |
| JP | 59-926 | B2 | 1/1984 |
| JP | 61-147515 | | 7/1986 |
| JP | 2-178906 | | 7/1990 |
| JP | 11-307362 | | 11/1999 |
| JP | 2008-258259 | | 10/2008 |
| JP | 2013-65740 | | 4/2013 |

OTHER PUBLICATIONS

International Search Report issued Jul. 3, 2012 in Application No. PCT/JP2012/058151.

Combined Chinese Office Action issued Jun. 30, 2015 in Patent Application No. 201280015687.5 (with English language translation).

* cited by examiner

- BACKGROUND ART -

- BACKGROUND ART -

ENERGY-STORING UNIT WITH FORCING MECHANISM, AND ON-LOAD TAP CHANGING DEVICE

CROSS-REFERENCE TO RELATED APPLICATIONS

This application is based upon and claims the benefit of priority from Japan Patent Application No. 2011-070782, filed on Mar. 28, 2011, the entire contents of which are incorporated herein by reference.

TECHNICAL FIELD

The present disclosure relates to an on-load tap changing device and an energy-storing unit with a forcing mechanism.

BACKGROUND

In recent years, a transformer, etc., is often provided with an on-load tap changing device that changes a voltage while applying a load current to the transformer, etc. It is important for the on-load tap changing device to ensure the swiftness of a tap changing operation, and thus large changing torque is obtained from an energy-storing unit. According to an energy-storing unit, stored spring force is released at once to rotate a crank at a fast speed, thereby performing a changing operation of a tap changer coupled with the crank within a short time.

The energy-storing unit is provided with a catch which is engaged with a craw formed on the crank and which holds a rotation thereof. The catch is once disengaged from the craw of the crank when releasing spring force, but after the changing operation of the tap changer completes and the crank rotates by a predetermined amount, the catch is engaged again with the craw of the crank. A position where the catch is engaged with the craw of the crank is referred to as a catch standby position.

Meanwhile, when a disturbance or a defect of the tap changer, etc., occurs, and necessary changing torque for the changing operation of the tap changer increases, there may be a case that the rotation amount of the crank becomes insufficient, and thus the craw of the crank does not reach the position of the catch, i.e., the catch does not return to the standby position in some cases. In this case, the catch is unable to be engaged with the craw, and to hold the rotation of the crank. Accordingly, it becomes difficult for the energy-storing unit to store spring force.

Hence, the energy-storing unit is provided with a forcing mechanism (see, for example, Patent Document 1) as an insurance mechanism when the catch does not move to the standby position. The forcing mechanism is a mechanism that forcibly moves the catch to the standby position after the original operation of the energy-storing unit.

Hereinafter, with reference to the perspective views of FIGS. 8 and 9, a detailed explanation will be given of an example conventional energy-storing unit with a forcing mechanism in an on-load tap changing device. As illustrated in those figures, an energy-storing unit is provided with a drive shaft 10 coupled with an electric actuation mechanism (unillustrated), and an eccentric cam 11 is attached to the drive shaft 10.

As illustrated in FIG. 8, the eccentric cam 11 is engaged with a hoist case 12 which is linked with the drive shaft 10 and the eccentric cam 11 reciprocates linearly in synchronization therewith. When the hoist case 12 moving linearly reaches a predetermined position, the hoist case 12 is set to release the engagement of a catch 15 with the craw of a crank 14 to be discussed later.

FIG. 9 illustrates a condition in which the hoist case 12 illustrated in FIG. 8 is detached. Disposed on the bottom face of the hoist case 12 are a spring (unillustrated) and an energy-storing case 13. The energy-storing case 13 reciprocates linearly together with the hoist case 12 through the spring.

The crank 14 that rotates in synchronization with the energy-storing case 13 is coupled to the bottom face of the energy-storing case 13, and a tap changer (unillustrated) is coupled with the crank 14. Moreover, the catch 15 is disposed near the crank 14. The catch 15 is configured to be engaged with the craw of the crank 14 at the standby position.

According to such an energy-storing unit, when the drive shaft 10 rotates upon reception of drive force from an electric actuator mechanism, the eccentric cam 11 rotates together with the rotation of the drive shaft 10. Hence, the hoist case 12 linked with the eccentric cam 11 linearly moves. The hoist case 12 moving linearly applies force to one end of the spring, while causes the energy-storing case 13 contacting the spring to reciprocate linearly. At this time, since the catch 15 at the standby position holds the rotation of the crank 14, the crank 14 does not rotate even though the energy-storing case 13 moves linearly. Hence, the spring is accumulating spring force along with the linear motion of the hoist case 12.

When the hoist case 12 that moves linearly reaches a predetermined position, the hoist case 12 disengages the craw of the crank 14 from the catch 15, and thus the catch 15 is released. Hence, the spring releases the spring force, and thus the energy-storing case 13 moves linearly at fast speed due to the spring force by the spring, and, the crank 14 in synchronization with the energy-storing casing 13 rotates at fast speed. The crank 14 transmits this rotation force to the tap changer, and the tap changer becomes able to perform a fast-speed tap changing operation.

Next, an explanation will be given of the structure of the forcing mechanism built in the energy-storing unit. The forcing mechanism includes a loading cam 16 in a special shape and formed on the eccentric cam 11, and a bearing 19 attached to the energy-storing case 13 (see FIG. 9). When rotating together with the eccentric cam 11, the loading cam 16 abuts the bearing 19, and pushes the bearing 19 in accordance with the shape of such a cam.

According to such a forcing mechanism, the loading cam 16 pushes the bearing 19 while utilizing the rotation torque of the drive shaft 10, thereby causing the sliding motion of the energy-storing case 13, and thus the crank 14 linked with the energy-storing casing 13 is forced to rotate. Hence, if a disturbance, etc., occurs and necessary changing torque for the changing operation of the tap changer increases, it becomes possible to avoid a case in which the rotation amount of the crank 14 becomes insufficient. Accordingly, the catch 15 can surely move to the standby position where the catch is engaged with the craw of the crank 14. According to the energy-storing unit including the above-explained forcing mechanism, even if a disturbance or a breakdown, etc., occurs, the catch 15 is always engaged with the craw of the crank 14, and thus the energy-storing unit can stably store spring force.

RELATED TECHNICAL DOCUMENTS

Patent Document

[Patent Document 1] JP 2008-258259 A

The conventional forcing mechanism has, however, the following disadvantages. That is, as the loading cam 16 rotating together with the eccentric cam 11 pushes the bearing 19, the contact point between the loading cam 16 and the bearing 19 becomes distant from the rotation center of the eccentric cam 11.

Hence, when the rotation of the loading cam 16 advances, loading torque increases. Moreover, as the rotation of the loading cam 16 advances together with the eccentric cam 11, a pressure angle becomes large, and thus a resistance from the bearing 19 becomes large. This is also a factor of loading torque increase.

When the loading torque in the forcing mechanism is large, in order to let the forcing mechanism to stably operate, with respect to components configuring such a mechanism, extremely precise shapes are necessary, and thus it is necessary to precisely manufacture the components. In addition, according to the above-explained forcing mechanism, the eccentric cam 11 is manufactured in such a way that the loading cam 16 in a special shape is attached thereto. Hence, attachment work is a difficult work, and the number of manufacturing steps increases.

As explained above, the forcing mechanism is an insurance mechanism for a changing operation by the tap changer when a disturbance or a breakdown occurs, and thus it is necessary for the forcing mechanism to stably operate. Hence, no reduction of the precision of the component is permitted which disturbs the stable driving, and the number of manufacturing steps is large. Accordingly, the manufacturing costs increase, resulting in a deterioration of a cost performance.

The present disclosure provides an embodiment of for addressing the above-explained disadvantages, and it is an object of the present disclosure to provide an energy-storing unit with a forcing mechanism and an on-load tap changing device provided with the same which employ an inexpensive and simple structure, and which enable a stable driving while suppressing loading torque.

SUMMARY

To accomplish the above object, according to an embodiment, there is provided an energy-storing unit with a forcing mechanism. The energy-storing unit includes: an eccentric cam linked with a drive shaft and moving in synchronization therewith; a hoist case which is linked with the eccentric cam and which reciprocates linearly in synchronization with the eccentric cam; a spring attached to the hoist case; an energy-storing case which is linked with the hoist case through the spring and which reciprocates linearly in synchronization with the hoist case; a crank which is linked with the energy-storing case and which rotates in synchronization with the energy-storing case; and a catch that is engaged with the crank at a predetermined standby position to lock a rotation of the crank and to compress the spring. The forcing mechanism built in the energy-storing unit employs a following structure.

That is, the forcing mechanism includes: a protrusion attached to the eccentric cam; a bearing attached to a tip of the protrusion; and a loading cam attached to the energy-storing case. The loading cam contacts with the bearing to rotate the crank through the energy-storing case, and moves the catch to the standby position.

DETAILED DESCRIPTION

Figure 8:
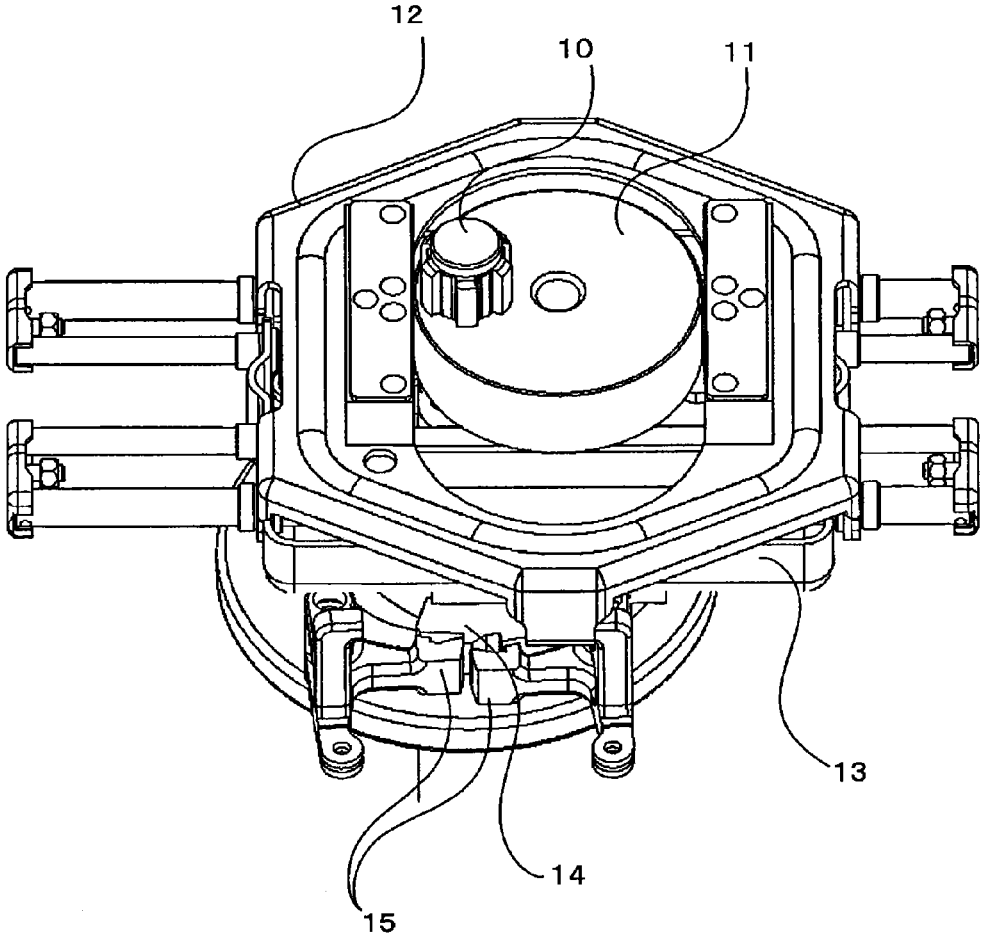
FIG. 8 is a perspective view illustrating a conventional energy-storing unit with a forcing mechanism.
Figure 9:
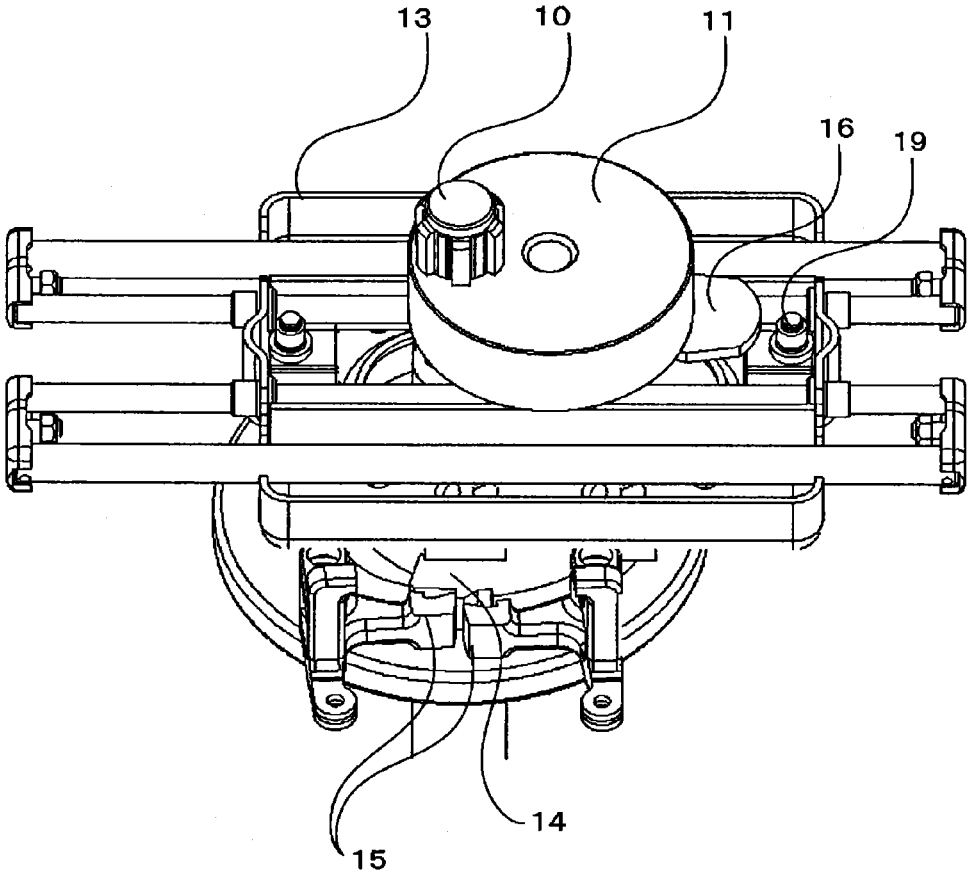
FIG. 9 is a perspective view illustrating the conventional energy-storing unit with the forcing mechanism.

A detailed explanation will be given of an energy-storing unit with a forcing mechanism according to an embodiment with reference to FIGS. 1 to 7. The embodiment has a technical feature in the forcing mechanism, and the basic structure and operation of the energy-storing unit are the same as those of the conventional technology illustrated in FIGS. 8 and 9.

[Structure of Energy-Storing Unit]

Figure 1:
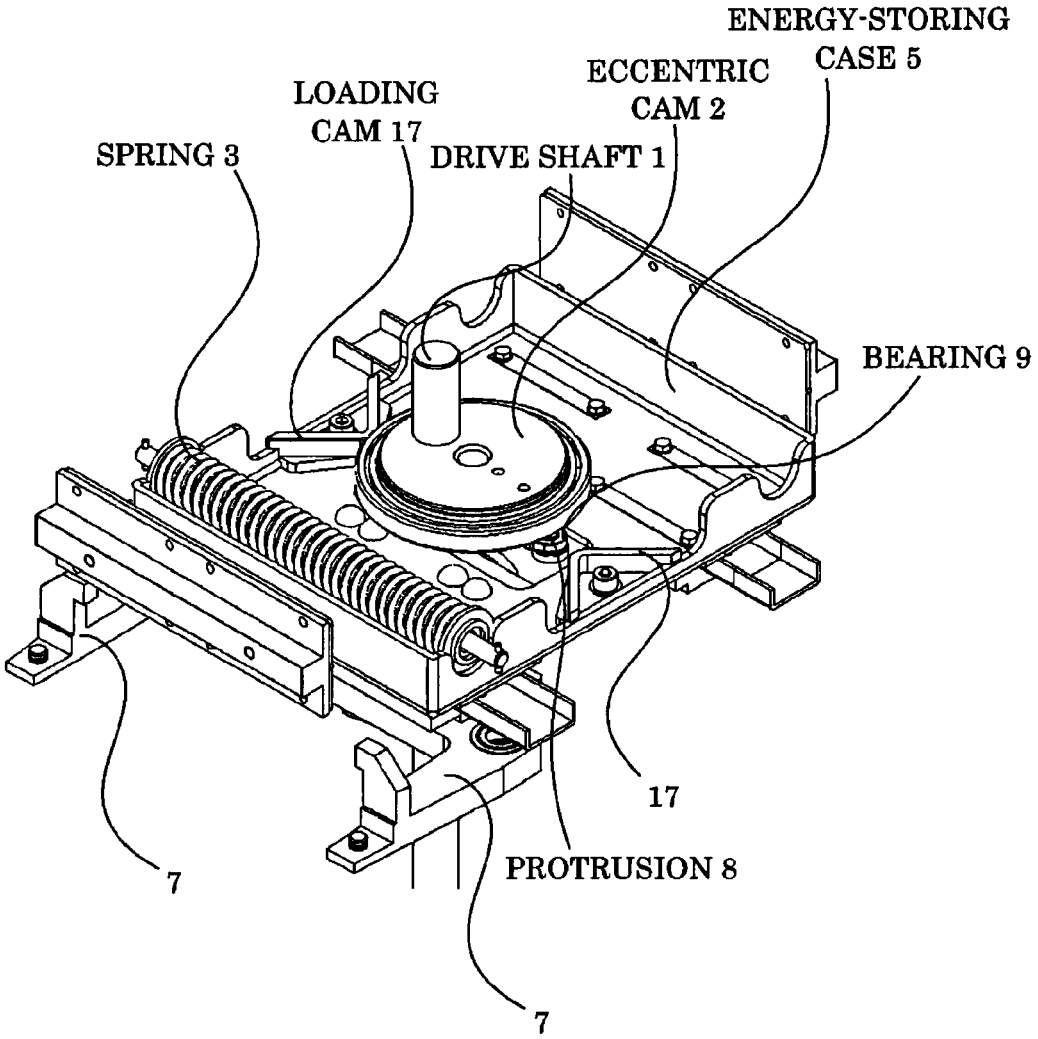
FIG. 1 is a perspective view of a typical embodiment as viewed from the top.

First, a structure of the energy-storing unit of this embodiment will be explained in detail with reference to FIGS. 1 and 2. As illustrated in FIG. 1, the energy-storing unit is provided with a drive shaft 1 coupled with an electric actuator mechanism (unillustrated), and an eccentric cam 2 moving in synchronization with the drive shaft 1 is attached to the drive shaft 1. A spring 3 is disposed adjacent to the eccentric cam 2, and an energy-storing case 5 is provided below the eccentric cam 2 and the spring 3 in a manner contacting with the spring 3. The energy-storing case 5 reciprocates linearly in synchronization with a hoist case 4 to be discussed later through the spring 3.

Figure 2:
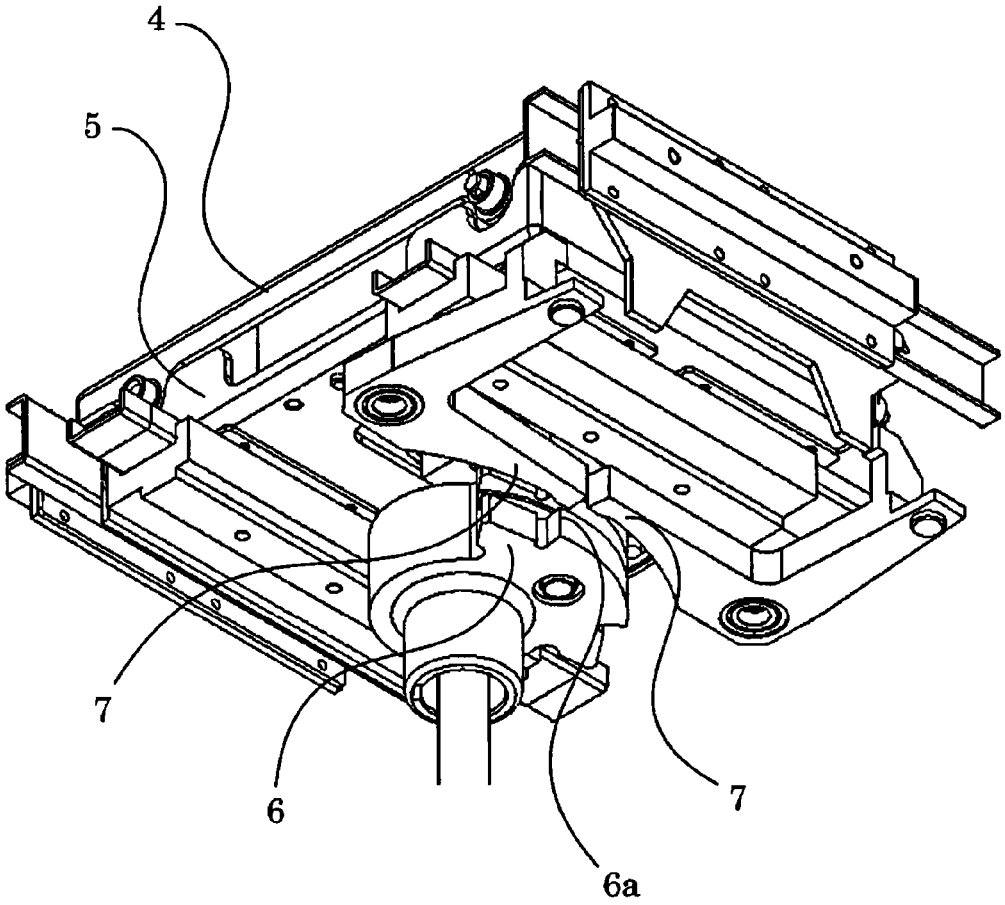
FIG. 2 is a perspective view of the typical embodiment as viewed from the bottom.

As illustrated in FIG. 2, the hoist case 4 is disposed on the top face of the energy-storing case 5. The hoist case 4 reciprocates linearly in synchronization with the eccentric cam 2. FIG. 1 is a perspective view of the embodiment as viewed from the top, but in order to facilitate understanding, the hoist case 4 is detached.

As illustrated in FIG. 2, a crank 6 is coupled to the bottom face of the energy-storing case 5. The crank 6 rotates in synchronization with the energy-storing case 5, and transmits rotation force to a tap changer (unillustrated). A catch 7 is disposed near the crank 6 so as to be detachably engaged with a craw 6*a* of the crank 6.

The catch 7 is engaged with the craw 6*a* of the crank 6 at a standby position set in advance to restrict the rotation of the crank 6, thereby compressing the spring 3. The engagement of the catch 7 with the craw 6*a* of the crank 6 is set to be disengaged by the hoist case 4 that has moved linearly by a predetermined stroke. The energy-storing unit includes the above-explained members, i.e., the drive shaft 1, the eccentric cam 2, the spring 3, the hoist case 4, the energy-storing case 5, the crank 6, and the catch 7.

[Operation of Energy-Storing Unit]

An explanation will be given of an operation of the energy-storing unit employing the above-explained structure. That is, when the drive shaft 1 rotates upon receiving drive force from the electric actuator mechanism, the eccentric cam 2 operating in synchronization with the drive shaft 1 rotates, and the hoist case 4 linked with the eccentric cam 2 moves linearly. The hoist case 4 that has moved linearly applies force to one end of the spring 3, while causes the energy-storing case 5 contacting with the spring 3 to reciprocate linearly.

The crank 6 linked with the energy-storing case 5 attempts to rotate in accordance with the linear reciprocal motion of the energy-storing case 5, but the catch 7 at the standby position is engaged with the craw 6*a* of the crank 6. That is, the rotation of the crank 6 is held, and the spring 3 accumulates spring force in accordance with the travel of the hoist case 4.

When the hoist case 4 linearly moves by a predetermined stroke, the hoist case 4 releases the engagement of the catch 7 with the craw 6*a* of the crank 6. Accordingly, the catch 7 is disengaged, and the spring 3 releases the spring force. As a result, upon receiving the spring force released by the spring 3, the energy-storing case 5 linearly moves at fast speed, and the crank 6 moving in synchronization with the energy-storing case 5 rotates at fast speed. The crank 6 transmits rotation force to the tap changer, and the tap changer becomes able to switch at fast speed.

[Structure of Forcing Mechanism]

The embodiment has a feature that the above-explained energy-storing unit is built with the following forcing mechanism. As illustrated in FIG. 1, the forcing mechanism includes a protrusion 8, a bearing 9, and a loading cam 17. Among those components, the protrusion 8 is attached to the bottom face of the eccentric cam 2, and the bearing 9 is attached to the tip of the protrusion 8.

The loading cam 17 is in an isosceles triangular shape having a vertex that is substantially 90 degrees, and is attached in such a way that the vertex faces along the right and left edges on the top face of the energy-storing case 5 facing with each other. The loading cam 17 slides when the bearing 9 disposed at the side of the eccentric cam 2 makes contact with the loading cam 17, and the energy-storing case 5 slides in synchronization with the loading cam 17.

Together with the sliding motion of the energy-storing case 5, the crank 6 linked with the energy-storing case 5 in synchronization therewith attempts to rotate, but in this case, the loading cam 17 is designed in such a way that, when the catch 7 moves to the standby position, the bearing 9 reaches the vertex of the loading cam 17. That is, the loading cam 17 contacts the bearing 9 so as to rotate the crank 6 through the energy-storing case 5, and moves the catch 7 to the standby position.

[Operation of Forcing Mechanism]

Figure 3A:
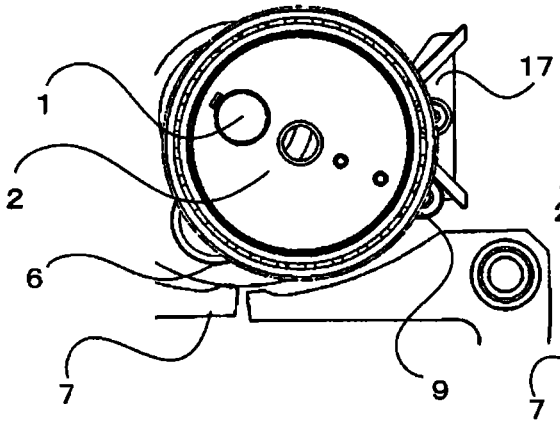
FIGS. 3A to 3F are plan views illustrating an operation of the typical embodiment.
Figure 3D:
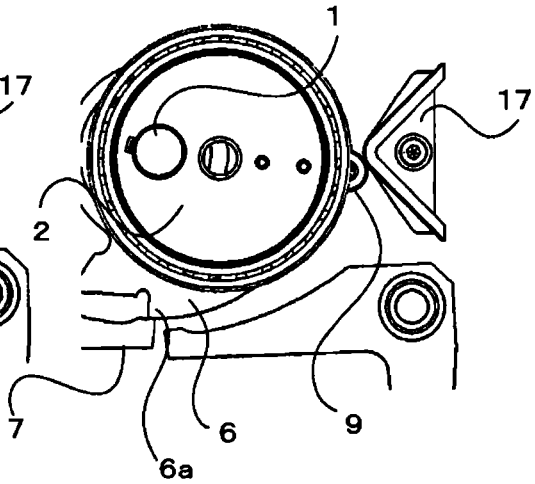
Figure 3B:
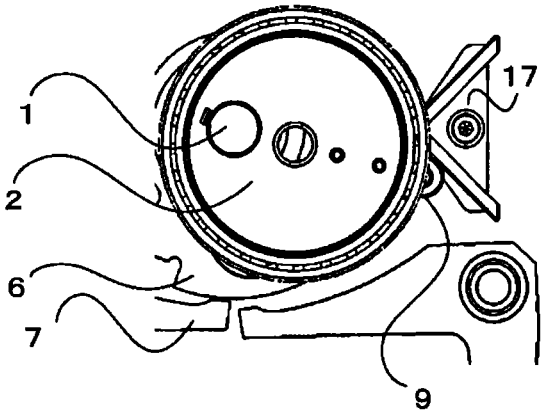
Figure 3E:
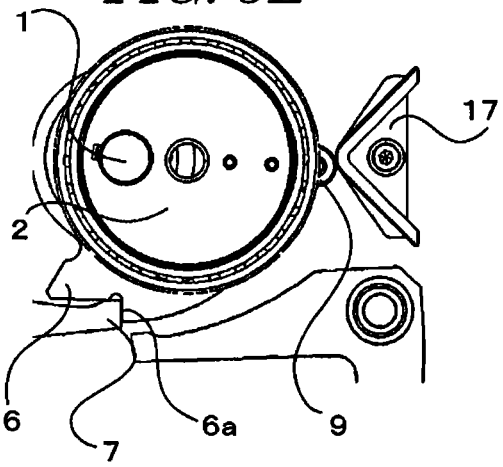
Figure 3C:
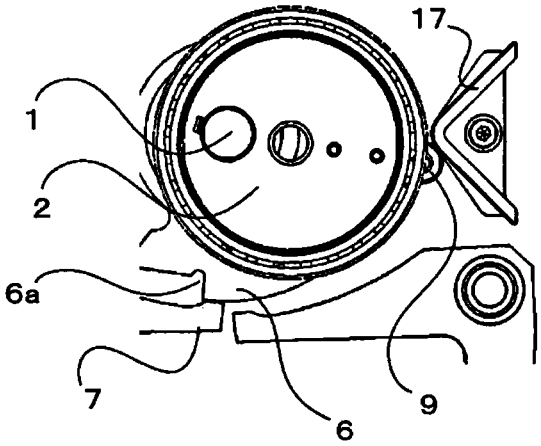
Figure 3F:
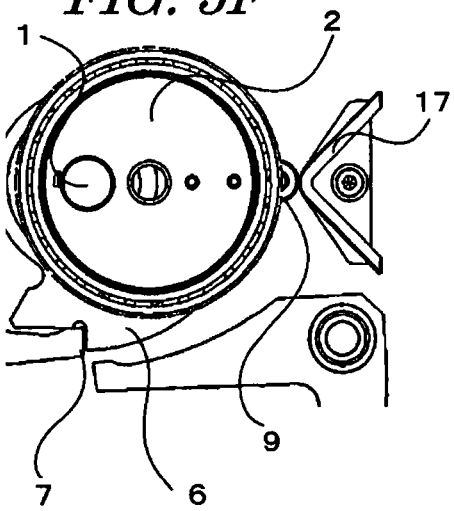

Next, an explanation will be given of an operation of the forcing mechanism of this embodiment with reference to FIGS. 3A to 3F. That is, when the bearing 9 contacts the loading cam 17 (FIG. 3A), the loading cam 17 starts sliding, and along with the rotation of the eccentric cam 2 in the counterclockwise direction, the bearing 9 pushes the loading cam 17 in the right direction in the figure. This advances the sliding motion of the loading cam 17 (FIGS. 3B to 3D).

Hence, the energy-storing case 5 to which the loading cam 17 is attached also slides in the right direction in the figure. Next, when the catch 7 is engaged with the craw 6*a* of the crank 6 and moves to the standby position (FIGS. 3E to 3F), the bearing 9 reaches the vertex of the loading cam 17.

Advantageous Effects

Figure 4:
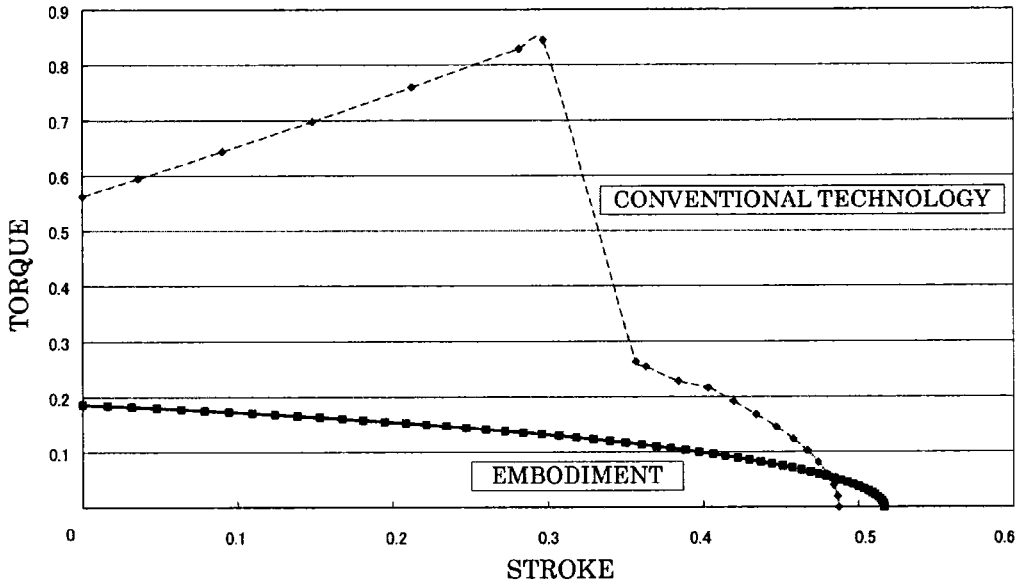
FIG. 4 is a graph for comparing a loading torque between a conventional technology and an embodiment.

The advantageous effects of this embodiment explained above are as follows. FIG. 4 is a graph based on an assumption that a load of 10 [N] is applied in the stroke direction, with the horizontal axis being as a stroke distance of the energy-storing case 5 that is slid by the forcing mechanism of this embodiment or the energy-storing case 13 that is slid by a conventional forcing mechanism, and with the vertical axis being as a loading torque in each distance.

As illustrated in FIG. 4, in the standby condition before the energy-storing case 5 slides, the loading torque of this embodiment is merely ⅓ or so in comparison with the conventional technology. In addition, the bearing 9 attached to the eccentric cam 2 pushes the loading cam 17, thereby causing the energy-storing case 5 to slide. Accordingly, there is no change in a distance from the rotation center of the eccentric cam 2 to the contact point between the bearing 9 and the loading cam 17.

Hence, according to this embodiment, even if the rotation of the eccentric cam 2 advances, the pressure angle between the bearing 9 and the loading cam 17 is always constant. As a result, the loading torque at the contact point between the bearing 9 and the loading cam 17 decreases as the stroke distance of the energy-storing case 5 increases.

That is, according to this embodiment, conversely to the conventional technology having the loading torque increasing together with the rotation of the eccentric cam 11, the loading torque to the drive shaft 1 gradually becomes small. This embodiment can remarkably reduce the loading torque in this manner. According to the example illustrated in FIG. 4, in comparison with a time point at which the loading torque of the forcing mechanism in the conventional technology becomes maximum, the loading torque of the forcing mechanism of this embodiment is substantially ⅛ of the conventional loading torque.

According to this embodiment that suppresses the loading torque in this manner, the forcing mechanism can operate stably without the need of precise shapes and precise manufacturing of components unlike the conventional technology. Hence, the forcing mechanism that is an insurance mechanism when the catch 7 does not move to the standby position can provide an excellent reliability.

Moreover, according to this embodiment, in addition to the unnecessity of the use of expensive precise components, in comparison with the conventional technology which has the number of manufacturing processes that is likely to increase, a simple structure is employed and thus the attaching works of the loading cam 17 and the bearing 9 are quite simple. The loading cam 17 is in a cam shape that is an isosceles triangle having a vertex that is substantially 90 degrees, and thus the rotation angle, the loading torque, and the stroke are well-balanced in an optimized manner. Such a shape facilitates machining, and thus the productivity is excellent. Hence, the manufacturing costs can be reduced, and the cost performance remarkably increases.

Moreover, according to the loading cam 17 that is an isosceles triangle having a vertex that is substantially 90 degrees, the contact timing with the bearing 9 can be delayed since a side contacting with the bearing 9 is inclined. Accordingly, although the rotation angle of the crank 6 is small, a large stroke distance can be accomplished, and thus the catch 7 can be surely moved to the standby position.

According to the forcing mechanism of this embodiment that can obtain a large stroke distance although the rotation angle of the crank 6 is small as explained above, the operation of the energy-storing unit is not disturbed. Therefore, the forcing mechanism of this embodiment is quite suitable as an insurance mechanism of the energy-storing unit, i.e., a mechanism that follows the original operation of the energy-storing unit.

Other Embodiments

While certain embodiments have been described, these embodiments have been presented by way of example only, and are not intended to limit the scope of the inventions. Indeed, the methods and apparatuses described herein may be embodied in a variety of other forms; furthermore, various omissions, substitutions and changes in the form of the embodiments described herein may be made without departing from the spirit of the disclosures.

The accompanying claims and their equivalents are intended to cover such forms or modifications as would fall within the scope and spirit of the inventions. For example, another embodiment of the present disclosure is an on-load tap changing device including the energy-storing unit with the above-explained forcing mechanism.

The shape of a contacting portion between the loading cam and the bearing can be changed as needed, and by adjusting the loading torque of the forcing mechanism and the rotation angle, etc., of the bearing and that of the loading cam, the shape of the loading cam can be designed in accordance with necessary loading torque for changing of the tap changer.

Figure 5:
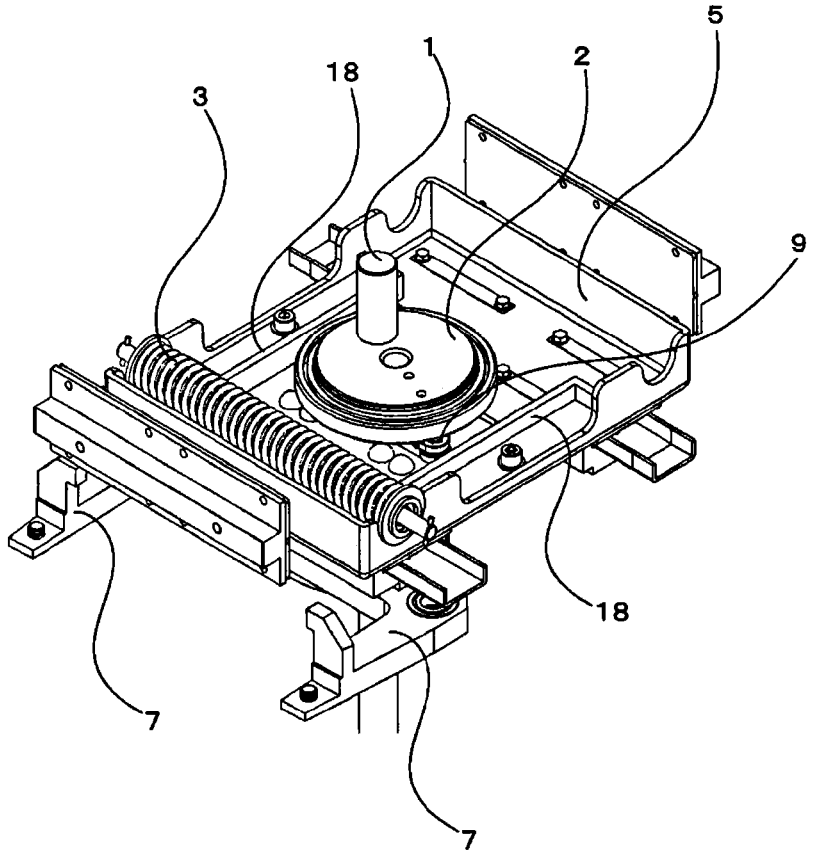
FIG. 5 is a perspective view of another embodiment.
Figure 6:
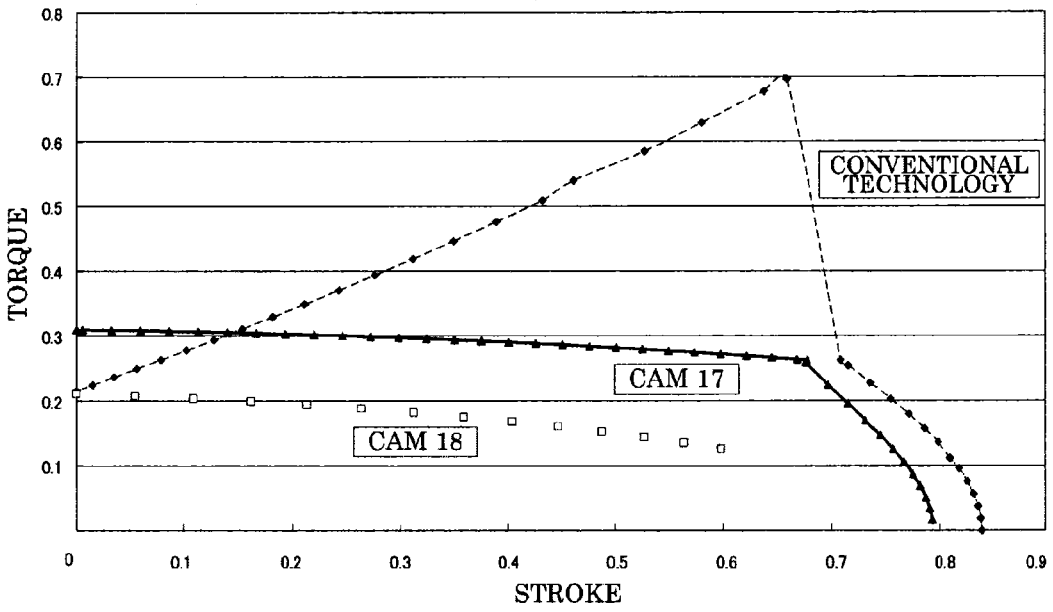
FIG. 6 is a graph for comparing a loading torque between a conventional technology, the typical embodiment and another embodiment.

More specifically, as illustrated in FIG. 5, instead of the loading cam 17 in an isosceles triangle shape, a thin square-bracket-shaped loading cam 18 may be used. According to such a loading cam 18, as illustrated in the graph of FIG. 6, the loading torque can be further reduced.

Figure 7:
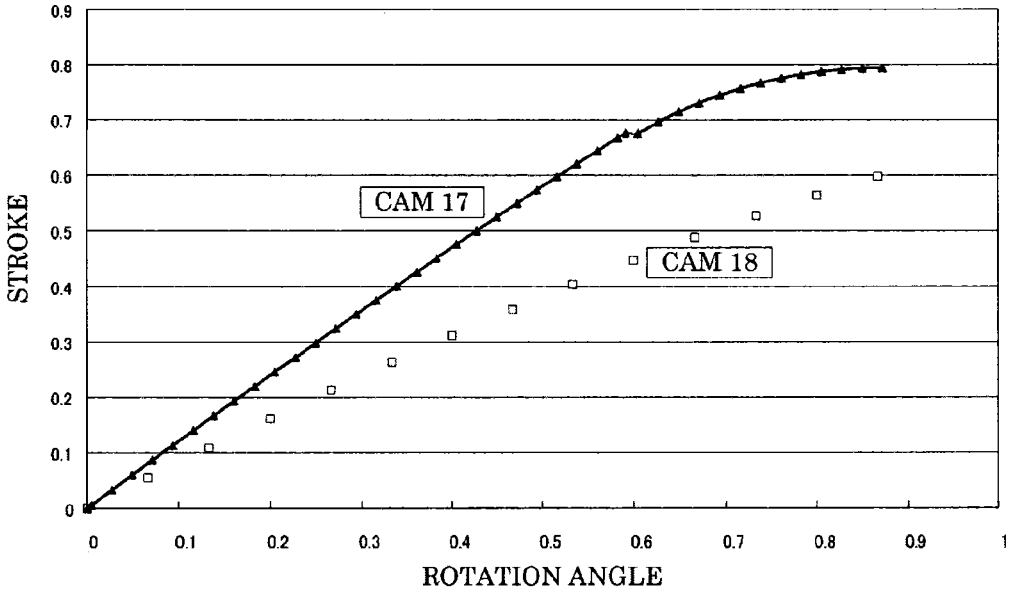
FIG. 7 is a graph for comparing a rotation angle between the typical embodiment and another embodiment with respect to a stroke distance of a loading cam.

Meanwhile, when the rotation angle in a stroke distance is compared between the loading cam 17 and the loading cam 18, as illustrated in FIG. 7, the forcing mechanism with the loading cam 17 is advantageous. In the graph of FIG. 6, the forcing mechanism with the loading cam 18 has the maximum stroke distance set at the rotation angle of 40 degrees, and the forcing mechanism with the loading cam 17 and the conventional forcing mechanism have the final stroke distances substantially matched with each other in respective configurations.

DESCRIPTION OF REFERENCE NUMERALS

1, 10 Drive shaft
2, 11 Eccentric cam
3 Spring
4, 12 Hoist case
5, 13 Energy-storing case
6, 14 Crank
7, 15 Catch
8 Protrusion
9, 19 Bearing
16, 17, 18 Loading cam

The invention claimed is:

1. An energy-storing unit forcing mechanism, the energy-storing unit comprising:
- an eccentric cam linked with a drive shaft and moving in synchronization therewith;
- a hoist case which is linked with the eccentric cam and which reciprocates linearly in synchronization with the eccentric cam;
- a spring attached to the hoist case;
- an energy-storing case which is linked with the hoist case through the spring and which reciprocates linearly in synchronization with the hoisting case;
- a crank which is linked with the energy-storing case and which rotates in synchronization with the energy-storing case; and
- a catch that is engaged with the crank at a predetermined standby position to lock a rotation of the crank and to compress the spring, the forcing mechanism comprising:
- a protrusion attached to the eccentric cam;
- a bearing attached to a tip of the protrusion; and
- a loading cam attached to the energy-storing case, the loading cam directly contacting with the bearing to rotate the crank through the energy-storing case, and move the catch to the standby position.

2. The energy-storing unit with the forcing mechanism according to claim 1, wherein the loading cam has a cam shape that is an isosceles triangle.

3. An on-load tap changing device comprising the energy-storing unit with the forcing mechanism according to claim 1.

4. An on-load tap changing device comprising the energy-storing unit with the forcing mechanism according to claim 2.

* * * * *